US005479949A

United States Patent [19]

Battard et al.

[11] Patent Number: 5,479,949

[45] Date of Patent: Jan. 2, 1996

[54] SHEET MATERIAL FOR A SMOKING PRODUCT INCORPORATING AN AROMATIC SUBSTANCE

[75] Inventors: Jean C. Battard, Saran; Jean M. E. Mane, Grasse; Daniel Esnault, Saint Jean De La Ruelle, all of France

[73] Assignee: Societe Nationale d'Exploitation Industrielle des Tabacs et Allumette and Establissements V., France

[21] Appl. No.: 133,048

[22] PCT Filed: Apr. 14, 1992

[86] PCT No.: PCT/FR92/00331

§ 371 Date: Oct. 12, 1993

§ 102(e) Date: Oct. 12, 1993

[87] PCT Pub. No.: WO92/18020

PCT Pub. Date: Oct. 29, 1992

[30] Foreign Application Priority Data

Apr. 17, 1991 [FR] France ..... 91 04721

[51] Int. Cl.[6] ..... A24D 1/02

[52] U.S. Cl. ..... 131/365; 131/353; 131/370

[58] Field of Search ..... 131/365, 361, 131/364, 352, 353, 359, 357, 370, 372, 374

[56] References Cited

U.S. PATENT DOCUMENTS

| | | | |
|---|---|---|---|
| 2,886,042 | 5/1959 | Hoover . | |
| 3,047,431 | 7/1962 | Bon Aire et al. . | |
| 3,426,011 | 2/1969 | Parmerter . | |
| 4,881,555 | 11/1989 | Bolt et al. | 131/364 |
| 4,906,488 | 3/1990 | Pera . | |
| 4,924,883 | 5/1990 | Perfetti et al. | 131/336 |
| 4,941,486 | 7/1990 | Dube et al. . | |
| 5,137,034 | 8/1992 | Perfetti et al. | 131/194 |
| 5,144,964 | 9/1992 | Demain | 131/277 X |

FOREIGN PATENT DOCUMENTS

| | | |
|---|---|---|
| 251132 | 1/1988 | European Pat. Off. . |
| 1171043 | 11/1969 | United Kingdom . |

*Primary Examiner*—Jennifer Bahr

*Attorney, Agent, or Firm*—Rosenman & Colin

[57] ABSTRACT

A process and sheet material made therefrom, for preparation of a sheet material intended for the manufacture of smoking products such as cigars, cigarettes, or similar products, in which aromatic substances or preparations intended not to be released until the moment of combustion of the smoking product and which are included by molecular encapsulation or complexing in cyclodextrins are introduced into the paste used to make the sheet, wherein measures are taken so that the said aromatic substances are all included in cyclodextrins.

5 Claims, No Drawings

SHEET MATERIAL FOR A SMOKING PRODUCT INCORPORATING AN AROMATIC SUBSTANCE

This invention concerns a sheet material into which at least one aromatic substance has been incorporated, designed for the manufacture of smoking products, such as cigarettes, cigars, or similar products, as well as smoking products that include such a material.

The invention aims at preventing loss or premature modification of at least one aromatic substance before the product is smoked, without modifying the smoke unfavorably and without the substance being detectable before the product is smoked.

It also aims at releasing at least one aromatic substance into the primary and/or secondary flux throughout the smoking of the product, at a sufficiently low temperature to avoid thermal degradation of the said substance.

The sheet material according to the invention can be used as a wrapper for the product to be smoked.

It can also be used as reconstituted tobacco leaf, manufactured by a well-known paper-making technique.

It has already been proposed to incorporate aromatic or non-aromatic substances in the paste itself used in the manufacture of the paper.

Thus in the U.S. Pat. No. 2,886,042 (REYNOLDS) it was proposed to dissolve sodium and potassium salts in the initial paper pulp, but essentially for the purpose of improving the combustion properties of this paper and its quality.

In the patent EP 0251132 (SHIBANAI), it is proposed to include substances, notably perfumes, in cyclodextrin in order to form molecular-inclusion compounds and to mix them into the pulp and water used in paper manufacture, and particularly in wrapping paper.

In this patent, this molecular inclusion should not be total, because if it were, the paper would not release any odor of its own, which is the purpose sought by this patent.

We are speaking here of a prolonged aromatic effect, and it is due to the fact that molecules are partially adsorbed onto the cyclodextrins or in an emulsion in the mixture and that they evaporate progressively from it when it is applied to the paste during the course of manufacture. It has never been suggested that the cyclodextrins or the inclusion complexes be submitted to a thermal effect that degrades them in order to release the aromas.

In all previous documents, no measure is envisioned such that the aromatic substances incorporated in the paper intended to serve as a wrapper for a smoking product would be protected until the product is consumed and would be released at a sufficiently low temperature, that is, before being submitted to the high temperatures of the flame when the product is smoked, both in free combustion and in forced combustion.

The invention aims precisely at obtaining the above results, and it proposes for this a process for preparation of a sheet material intended for the manufacture of smoking products, such as cigars, cigarettes, or analogous products, in which one introduces into the paste itself used in the manufacture of the material, aromatic substances or preparations that are designed not to be released until the moment of combustion of the product to be smoked and that are included by molecular encapsulation or complexing in cyclodextrins, characterized by the fact that measures are taken so that the said aromatic substances are all included in the cyclodextrins.

This complete inclusion of the said substances can be realized, after the inclusion operation, by getting rid, by heating or washing for example, of the inclusion products of the said aromatic substances that were not included, in particular those that were simply adsorbed onto the surfaces of the cyclodextrins.

This removal of the substances that were not included can also be performed be drying the coating material in the paper machine itself.

Because of the fact of total inclusion, the said aromatic substances do not migrate in the tobacco and are preserved until the moment when, through the thermal degradation caused by the advance of the flame of the lit product, the cyclodextrins again release abruptly a part of the said aromatic substances they are protecting, this violent re-release continuing progressively throughout the smoking of the product.

Besides the said aromatic substances, the material can obviously be provided with other types of substances, for example those intended to release a natural odor without being degraded thermally. In that case they do not have to be enclosed or complexed as do the said substances.

We give below some examples of the manufacture of materials according to the invention.

EXAMPLE 1

We knead at room temperature (15° to 25° C.) a mixture consisting of three parts of β-cyclodextrin in powder form and one part of water to obtain a homogenous paste.

We mix about 13 percent by weight, with respect to the β-cyclodextrin, of vanillin, predissolved in ethyl alcohol.

We mix it until a complex is obtained. We dry it in a ventilated oven for 12 hours at about 40° C.

We treat the complex by heating it to 100° C. for 24 hours.

The powder thus obtained is added to water with agitation at a temperature below 15 degrees and at a concentration of 4%. The water may possibly contain salt. The solution thus obtained is kept at a temperature preferably below 15 degrees and placed in the size-press part of the paper machine.

The paper machine moves at 288 m/min with a width of 3.65 m. The consumption of the size press is on the order of 20 l/min.

Adjustments are made so as not to modify the grammage of the desired paper.

The paper obtained contains a total of 4%, with respect to the paper, of β-cyclodextrin/vanillin complex. This paper does not give off any odor, and it is used for making cigarettes with a mixture of mild tobacco in commercial cigarettes.

These cigarettes have been sampled by a panel of experts. They detected a tendency of a subtle and pleasant kind toward sweet traits of sugar and vanilla in the secondary smoke, without modification of the attractiveness of the primary smoke.

EXAMPLE 2

We proceed in the same manner as in Example 1 to prepare the complex, but we replace the vanillin by γ-undecalactone in the same proportions. The powder thus obtained is added to water with agitation, following the same concentration, but with previous addition of a suspension such as the bipolymer with the trademark Rhodopol BP 23 manufactured by Rhône-Poulenc.

The primary and secondary smoke of the cigarettes manufactured with this paper and with a mixture of mild tobacco have been strongly flavored with the selected trait.

EXAMPLE 3

We perform encapsulation of (–) carvone by using a mixture of 90% β-cyclodextrin and 10% of PMCD (partially methylated cyclodextrin manufactured by the Ringdex Company). We proceed in the same manner as in Example 1.

The smoke of the cigarettes manufactured with this paper has a spearmint aromatic trait. The irritation of the primary smoke is decreased, and the tobacco taste is reinforced. The secondary smoke is sweeter.

EXAMPLE 4

We knead at room temperature (15° to 25° C.) a mixture consisting of one part of β-cyclodextrin in powder form and three parts of water until a homogeneous mixture is obtained.

We add 1/10 part by weight of a coumarin flavoring.

We dry it at a temperature of less than 40° C. for about 12 hours.

We wash with an appropriate solvent in order to remove the flavoring that has not be encapsulated.

We grind it, followed by possible sifting, to obtain a powder with a grain size preferably between 1 and 100μ.

The powder obtained is suspended in water and we apply it (alone or mixed with other additives or compatible fillers) with a size press during the paper-making process. The concentration is adjusted as a function of the desired quantity according to the rate of deposition and the speed of the machine.

EXAMPLE 5

We knead, dry, for 15 to 20 minutes at ordinary temperature, 25.5 kg of pulverized β-cyclodextrin and 2.5 kg of flavoring. We add the 28 kg of paste obtained to 51 kg of cold water, and we stir it for 30–40 minutes at a fairly low temperature, less than 15 degrees.

The mixture thus encapsulated is placed in suspension-solution in 649 kg of water to which 0.2% of Rhodopol BP23 has been added, serving as suspensoid.

The solution obtained, maintained at a temperature below 15 degrees, is placed in the size press part of the paper machine. During drying, the molecules of flavoring that were not encapsulated into the cyclodextrin are eliminated by evaporation.

The paper obtained according to the invention does not give off any odor until the moment of combustion; then the flavoring is released abruptly, throughout the smoking, by thermal degradation of the cyclodextrins at about 280°–300° C., a few millimeters before the flame, without having to undergo degradation at the same level as the flame, that is, at 800° C.

EXAMPLE 6

We make a reconstituted tobacco according to the usual paper-making technique. However, the concentrated aqueous solution obtained from the juice from maceration of the tobacco powders in water is cooled, then kept at about 15° C. until application with the size press on the paper machine.

Moreover, encapsulation of an essential tobacco oil is achieved according to the process described in Example 4 in order to obtain 6% of complexed essential oil.

This complex is suspended in the concentrated aqueous solution which is applied with the size-press part of the paper machine. The rate of introduction of the complex is chosen as a function of the flow of the solution, the speed of the machine, and the rate at which the water is replenished, in a known manner and in such a way that we obtain a 0.1% fraction of flavoring in the final product.

The reconstituted tobacco thus obtained is introduced at a rate of 20% into the mild cigarette mixture.

Cigarettes manufactured with this mixture have been compared to other cigarettes prepared with an identical mixture but with reconstituted tobacco without cyclodextrins. The former ones were judged by a panel of experts to be oriented toward the American line more markedly than the latter ones.

EXAMPLE 7

We make a paste consisting of tobacco powder (10 to 15%), carboxymethyl cellulose (2%), and water (80 to 90%).

The paste thus obtained is transferred by pumping to the feeding hopper of a dryer consisting of a stainless-steel band and a drying tunnel, heated to about 150° C. We obtain on the drying band a uniform coating of paste deposited at a thickness of about 0.5 mm. Just before entering the drying tunnel, we scatter onto the paste, by means of a vibrator, the beta-cyclodextrin/vanillin complex obtained according to Example 1. The quantity used is about 5% with respect to the dry matter of the paste.

The homogenized tobacco obtained after drying does not give off any odor and is used to manufacture cigarillos with a mixture of commercial tobacco.

These cigarillos have been sampled by a panel of experts. They noted a sweetening of the smoke and a tendency in it toward traits of vanilla.

We claim:

1. A process for preparation of a sheet material for use in the manufacture of smoking products, wherein aromatic substances are introduced in a paste used in the manufacture of the sheet material, on a paper-making machine, in the form of molecular encapsulation of the aromatic substances in cyclodextrines; the improvement comprising maintaining an encapsulation complex of the aromatic substances in cyclodextrines in powder form in a suspension solution, at a temperature below 15° C., and wherein the process of preparation of the sheet material on the paper making machine comprises drying in a final drying section and wherein said suspension solution is introduced into said drying section, whereby aromatic substances not completely encapsulated in the cyclodextrines are eliminated by evaporation during said drying.

2. A sheet material intended to serve as a wrapper for a smoking product, obtained by the process of claim 1.

3. A smoking product comprising a wrapper which is a sheet material according to claim 2.

4. Reconstituted tobacco leaf comprised of the sheet material obtained by the process of claim 1.

5. A smoking product comprised of the tobacco leaf of claim 4.

* * * * *